US011158281B2

(12) United States Patent
Lv et al.

(10) Patent No.: US 11,158,281 B2
(45) Date of Patent: Oct. 26, 2021

(54) DISPLAY PANEL AND DRIVING METHOD FOR DRIVING THE DISPLAY PANEL

(71) Applicants: FUZHOU BOE OPTOELECTRONICS TECHNOLOGY CO., LTD., Fuzhou (CN); BOE TECHNOLOGY GROUP CO., LTD., Beijing (CN)

(72) Inventors: Yaochao Lv, Beijing (CN); Hao Cheng, Beijing (CN); Zongxiang Li, Beijing (CN); Jiamin Liao, Beijing (CN); Wenchang Tao, Beijing (CN); Guichun Hong, Beijing (CN); Zhendian Wu, Beijing (CN); Linlin Lin, Beijing (CN); Zuwen Liu, Beijing (CN); Jin Wang, Beijing (CN); Xinmao Qiu, Beijing (CN); Changhong Shi, Beijing (CN); Zihua Zhuang, Beijing (CN); Min Zhou, Beijing (CN); Yawen Huang, Beijing (CN); Yao Liu, Beijing (CN); Jingguang Zhu, Beijing (CN); Jiantao Lin, Beijing (CN); Xi Chen, Beijing (CN)

(73) Assignees: FUZHOU BOE OPTOELECTRONICS TECHNOLOGY CO., LTD., Fuzhou (CN); BOE TECHNOLOGY GROUP CO., LTD., Beijing (CN)

( * ) Notice: Subject to any disclaimer, the term of this patent is extended or adjusted under 35 U.S.C. 154(b) by 0 days.

(21) Appl. No.: 16/633,388

(22) PCT Filed: Nov. 26, 2018

(86) PCT No.: PCT/CN2018/117416
§ 371 (c)(1),
(2) Date: Jan. 23, 2020

(87) PCT Pub. No.: WO2020/107148
PCT Pub. Date: Jun. 4, 2020

(65) Prior Publication Data
US 2021/0065646 A1 Mar. 4, 2021

(51) Int. Cl.
*G09G 3/36* (2006.01)

(52) U.S. Cl.
CPC ..... *G09G 3/3696* (2013.01); *G09G 2310/08* (2013.01)

(58) Field of Classification Search
CPC ..... G09G 3/3696; G09G 2310/08
See application file for complete search history.

(56) References Cited

U.S. PATENT DOCUMENTS 8,054,272 B2 11/2011 Lee et al.
10,535,837 B2 1/2020 Chung et al.
(Continued)

FOREIGN PATENT DOCUMENTS

CN 101661723 A 3/2010
CN 106023877 A 10/2016
(Continued)

*Primary Examiner* — Lisa S Landis
(74) *Attorney, Agent, or Firm* — Dilworth & Barrese, LLP.; Michael J. Musella, Esq.

(57) ABSTRACT

Provided are a display panel and a driving method thereof. The display panel includes an array substrate, the display panel including a display region and a peripheral region. In the peripheral region, a common voltage wiring, a voltage feedback wiring, a periodic signal wiring, and a decoupling wiring are disposed on the array substrate at intervals; the common voltage wiring is configured to transmit a common voltage signal for display to a pixel array in the display region, the voltage feedback wiring is configured to transmit a voltage feedback signal for monitoring changes in the
(Continued)

common voltage signal, the periodic signal wiring is configured to provide the pixel array with a periodic signal for display, the decoupling wiring is located between the periodic signal wiring and the voltage feedback wiring, and is configured to transmit a decoupling signal for reducing coupling distortion of the voltage feedback signal.

18 Claims, 8 Drawing Sheets

(56) References Cited

U.S. PATENT DOCUMENTS

| | | | | |
|---|---|---|---|---|
| 2012/0218250 | A1 | 8/2012 | Pei et al. | |
| 2018/0047357 | A1* | 2/2018 | Chen | G09G 3/3655 |

FOREIGN PATENT DOCUMENTS

| | | | |
|---|---|---|---|
| CN | 107577365 | A | 1/2018 |
| CN | 108073325 | A | 5/2018 |

* cited by examiner

DISPLAY PANEL AND DRIVING METHOD FOR DRIVING THE DISPLAY PANEL

TECHNICAL FIELD

Embodiments of the present disclosure relate to a display panel and a driving method thereof.

BACKGROUND

Liquid crystal display devices (LCDs), as the most common flat panel display devices, have been widely used in various applications. Organic light emitting diode (OLED) display devices have gradually attracted extensive attention due to advantages such as wide viewing angles, high contrast, fast response speed, and higher luminous brightness and lower driving voltage compared with inorganic light-emitting display devices. Liquid crystal display devices and organic light emitting diodes (OLEDs) may be applied to devices with display functions such as mobile phones, displays, notebook computers, digital cameras, instruments and meters.

SUMMARY

At least one embodiment of the present disclosure provides a display panel comprising an array substrate, the display panel comprising a display region and a peripheral region surrounding the display region, wherein: in the peripheral region, a common voltage wiring, a voltage feedback wiring, a periodic signal wiring, and a decoupling wiring are disposed on the array substrate at intervals; the common voltage wiring is configured to transmit a common voltage signal for display to a pixel array in the display region, the voltage feedback wiring is configured to transmit a voltage feedback signal for monitoring changes in the common voltage signal, the periodic signal wiring is configured to provide the pixel array with a periodic signal for display, the decoupling wiring is located between the periodic signal wiring and the voltage feedback wiring, and is configured to transmit a decoupling signal for reducing coupling distortion of the voltage feedback signal caused by coupling effect of the periodic signal.

For example, in a display panel provided by an embodiment of the present disclosure, the decoupling signal is a periodic pulse signal; a pulse period of the decoupling signal is equal to a period in which the voltage feedback signal undergoes the coupling distortion, a phase of the decoupling signal is opposite to a phase of the voltage feedback signal undergoing coupling distortion.

For example, in a display panel provided by an embodiment of the present disclosure, a pulse width of the decoupling signal is equal to a time during which the voltage feedback signal undergoes the coupling distortion.

For example, in a display panel provided by an embodiment of the present disclosure, a pulse width of the decoupling signal is greater than a time during which the voltage feedback signal undergoes the coupling distortion.

For example, in a display panel provided by an embodiment of the present disclosure, the periodic signal wiring includes a clock signal wiring and/or a frame start signal wiring.

For example, in a display panel provided by an embodiment of the present disclosure, the display panel further comprises a signal processing circuit, the signal processing circuit is connected to the decoupling wiring and is configured to output the decoupling signal to the decoupling wiring.

For example, in a display panel provided by an embodiment of the present disclosure, in the peripheral region, a ground wiring separated from the voltage feedback wiring is further provided on the array substrate, and an earth capacitance is formed between the voltage feedback wiring and the ground wiring.

For example, in a display panel provided by an embodiment of the present disclosure, in the peripheral region, the array substrate further comprises a first conductive layer and a connection electrode, the first conductive layer is insulated from the ground wiring, an orthographic projection of the first conductive layer on the array substrate and an orthographic projection of the ground wiring on the array substrate at least partially overlap, and the first conductive layer is electrically connected to the voltage feedback wiring, so that the earth capacitance is formed between the first conductive layer and the ground wiring; the connection electrode is electrically connected to the first conductive layer via a first through hole and is insulated from the ground wiring, and the connection electrode is electrically connected to the voltage feedback wiring via a second through hole.

For example, in a display panel provided by an embodiment of the present disclosure, in the peripheral region, the array substrate further comprises a first conductive layer and a connection electrode, the first conductive layer is insulated from the voltage feedback wiring, an orthographic projection of the first conductive layer on the array substrate and an orthographic projection of the voltage feedback wiring on the array substrate at least partially overlap, and the first conductive layer is electrically connected to the ground wiring, so that the earth capacitance is formed between the first conductive layer and the voltage feedback wiring; the connection electrode is electrically connected to the first conductive layer via a first through hole and is insulated from the voltage feedback wiring, and the connection electrode is electrically connected to the ground wiring via a second through hole.

For example, in a display panel provided by an embodiment of the present disclosure, the first conductive layer and a gate or a source-drain of a thin film transistor in the display region are formed in a same layer and a same material.

For example, in a display panel provided by an embodiment of the present disclosure, the ground wiring and the voltage feedback wiring are formed in a same layer and a same material on the array substrate.

For example, a display panel provided by an embodiment of the present disclosure further comprises an opposite substrate, wherein: a black matrix is disposed on the opposite substrate, and a thickness of the black matrix disposed in a first region is smaller than a thickness of the black matrix disposed in a second region, the first region is a region including orthographic projections of the voltage feedback wiring and the periodic signal wiring on the opposite substrate, and the second region is a region on the opposite substrate outside the first region.

For example, in a display panel provided by an embodiment of the present disclosure, the first region further comprises a region of orthographic projections of the common voltage wiring and the decoupling wiring on the opposite substrate.

For example, in a display panel provided by an embodiment of the present disclosure, the opposite substrate comprises a color film substrate.

At least one embodiment of the present disclosure provides a driving method for the display panel according to claim 1, comprising: transmitting the decoupling signal via the decoupling wiring, and the decoupling signal is used to reduce coupling distortion of the voltage feedback signal caused by coupling effect of the periodic signal.

For example, in a driving method provided by an embodiment of the present disclosure, the decoupling signal is a periodic pulse signal; a pulse period of the decoupling signal is equal to a period in which the voltage feedback signal undergoes the coupling distortion, a phase of the decoupling signal is opposite to a phase of the voltage feedback signal undergoing the coupling distortion.

For example, in a driving method provided by an embodiment of the present disclosure, a pulse width of the decoupling signal is equal to a time during which the voltage feedback signal undergoes the coupling distortion.

For example, in a driving method provided by an embodiment of the present disclosure, a pulse width of the decoupling signal is greater than a time during which the voltage feedback signal undergoes the coupling distortion.

BRIEF DESCRIPTION OF THE DRAWINGS

In order to illustrate technical solutions of the embodiments of the present disclosure more clearly, accompanying drawings of the embodiments will be briefly introduced below. Obviously, the drawings in the following description only involve some embodiments of the present disclosure, rather than act as a limitation to the present disclosure.

DETAILED DESCRIPTION

In order to make objectives, technical solutions and advantages of the embodiments of the present disclosure clearer, the technical solutions of the embodiments of the present disclosure will be described clearly and thoroughly in conjunction with the accompanying drawings of the embodiments of the present disclosure. Obviously, the described embodiments are a part but not all of the embodiments of the present disclosure. All other embodiments obtained by a person of ordinary skill in the art based on the described embodiments of the present disclosure without creative labor shall fall within the scope of the present disclosure.

Technical terms or scientific terms used in the present disclosure have ordinary meanings that should be understood by a person of ordinary skill in the art of the present disclosure, unless otherwise specified. Terms such as "first", "second" and the like used in the present disclosure do not indicate any order, quantity or importance, but are used to distinguish different components. Likewise, terms such as "a", "an", or "the" and the like do not indicate a limitation on quantity, but indicate that there is at least one. Terms such as "comprise", "include" and the like mean that elements or objects before the terms contain elements or objects or equivalents thereof listed after the terms, without excluding other elements or objects. Terms such as "connection" or "connect" and the like are not limited to physical or mechanical connections, but may comprise electrical connections, whether directly or indirectly. "Up", "down", "left", "right", etc. are only used to indicate a relative position relationship, and when an absolute position of a described object changes, the relative position relationship may also change accordingly.

Figure 1:
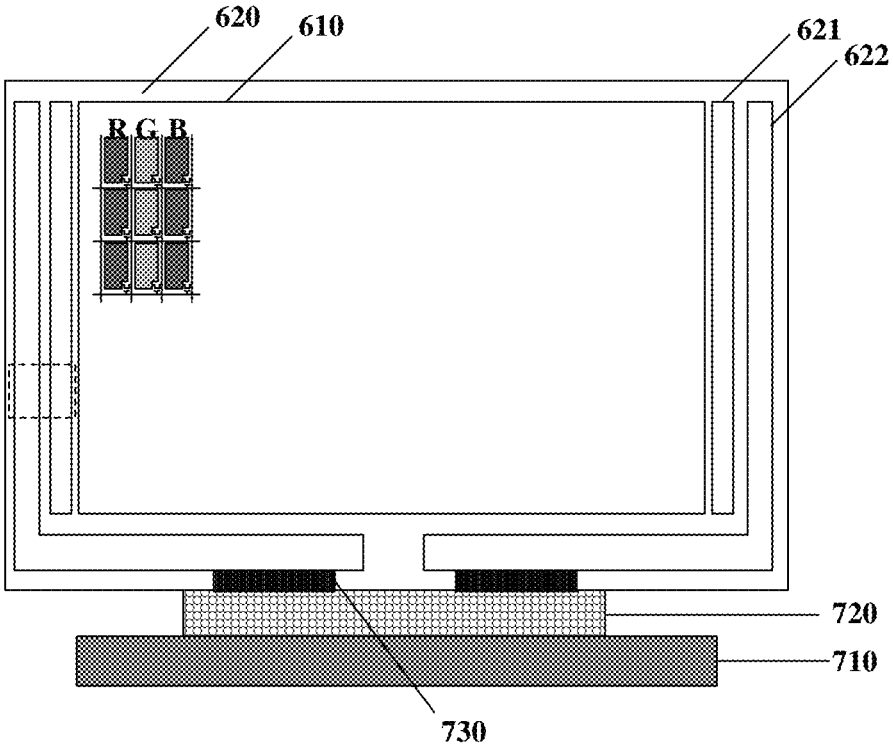
FIG. 1 is a schematic diagram of a display panel.

FIG. 1 shows a schematic diagram of a display panel. For example, the display panel is a liquid crystal display panel. As shown in FIG. 1, the display panel includes a display region 610 and a peripheral region 620 surrounding the display region 610. For example, a pixel array composed of a plurality of rows and a plurality of columns of pixel units (for example, each pixel includes three kinds of pixel units RGB) is disposed in the display region 610 for display operations. It should be noted that only three rows and three columns of pixel units are schematically shown in FIG. 1, and the embodiments of the present disclosure include but are not limited thereto.

Figure 2:
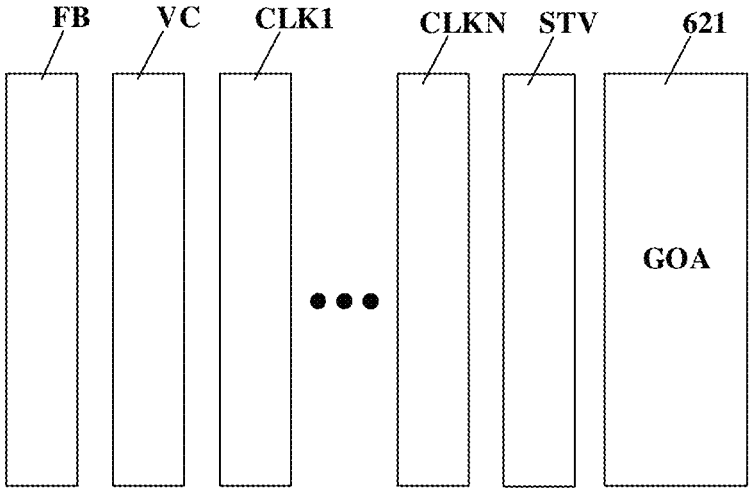
FIG. 2 is a schematic diagram of a portion corresponding to a dotted frame in FIG. 1.

For example, as shown in FIG. 1, the peripheral region 620 includes a driving circuit region 621 and a wiring region 622. A driving circuit for driving the pixel array is disposed in the driving circuit region 621. For example, the driving circuit may adopt a gate driver on array (GOA) circuit. A plurality of wirings are disposed at intervals in the wiring region 622, which, for example, may be parallel and insulated when they are arranged. FIG. 2 shows a schematic diagram of a portion corresponding to a dotted frame in FIG. 1. For example, as shown in FIG. 2, the plurality of wirings includes a common voltage wiring VC, a voltage feedback wiring FB, a frame start signal wiring STV, and a plurality of clock signal wirings (CLK1 . . . CLKN).

For example, as shown in FIG. 1, ends of the plurality of wirings may be connected to a printed circuit board 710 via electrode pins 730 and a flexible circuit film 720. For example, circuits disposed on the printed circuit board 710 may provide various signals required for driving display operations to the GOA circuit via the plurality of wirings. These signals include clock signal(s) (CLK), a frame start signal (STV) and a power voltage signal (VDD), etc.

For example, when the display panel in FIG. 1 is a liquid crystal display panel, the display operations drive liquid crystal molecules to deflect mainly by a voltage difference between a data voltage applied to a pixel electrode in each pixel unit and a common voltage Vcom applied to a common electrode, thereby various grayscale displays are achieved. Therefore, stability of the common voltage Vcom becomes very important when the display operations are performed.

For example, as shown in FIG. 2, the common voltage Vcom may be provided to the pixel array via the common voltage wiring VC. For example, in order to keep the common voltage Vcom stable, the common voltage Vcom in the display panel may be monitored and reversely compensated according to changes in the common voltage Vcom, so that the common voltage Vcom in the display panel is maintained at a stable value.

For example, as shown in FIG. 2, the voltage feedback wiring FB may be disposed in the wiring region 622, and the voltage feedback wiring FB is used to transmit a voltage feedback signal for monitoring the changes in the common voltage Vcom. For example, the voltage feedback signal may be transmitted to a signal processing circuit disposed in the printed circuit board 710. For example, the signal processing circuit may perform reverse compensation on the common voltage Vcom according to the voltage feedback signal, so that the common voltage Vcom in the display panel may be maintained at a stable value.

In a display panel driven by the GOA circuit, since a variety of different signals need to be provided to the GOA circuit, density of the wirings in the wiring region 622 is large. For example, the clock signals provided by the plurality of clock signal wirings (CLK1 . . . CLKN, N is an integer greater than 1) and the frame start signal provided by the STV wiring are all periodic signals, in which case the voltage feedback signal transmitted by the voltage feedback wiring FB is easily subjected to coupling effect by these periodic signals, resulting in periodic distortion of the voltage feedback signal. When receiving the voltage feedback signal with periodic distortion, the signal processing circuit would consider that the common voltage Vcom has changed, and then perform reverse compensation on the common voltage Vcom, which causes corresponding periodic distortion to appear in the common voltage Vcom of the display panel, resulting in periodic horizontal stripes on the display panel when images are displayed and thus impact on display quality.

Figure 3:
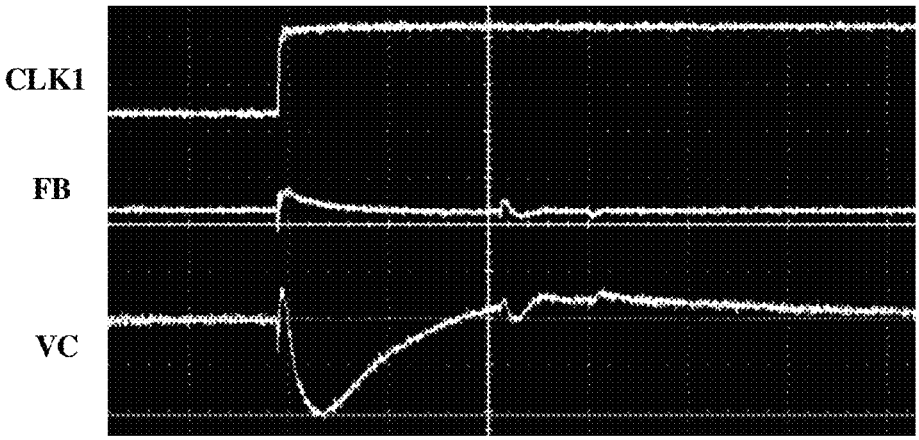
FIG. 3 is a signal timing diagram of the display panel shown in FIG. 1 when periodic horizontal stripe defects occur.

FIG. 3 is a schematic diagram showing occurrence of the above-mentioned periodic horizontal stripe defects. From top to bottom in FIG. 3 is the clock signal transmitted by the clock signal wiring CLK1, the voltage feedback signal transmitted by the voltage feedback wiring FB, and the common voltage Vcom transmitted by the common voltage wiring VC after reverse compensation. It should be noted that the above reverse compensation may be doubled or multiplied. For example, an example of multiplied reverse compensation is shown in FIG. 3. Compensation multiple for reverse compensation needs to be determined according to actual situations. When the compensation multiple is too large, signal distortion of the voltage feedback signal due to coupling will also be amplified, and thus the periodic horizontal stripe defects described above may be improved by reducing the compensation multiple. However, due to fluctuations of processing technologies, a determined compensation multiple cannot be fully applied to all generated products. Therefore, it is necessary to reduce the coupling effect to the voltage feedback wiring FB as much as possible in the display panel itself.

At least one embodiment of the present disclosure provides a display panel comprising an array substrate. The display panel includes a display region and a peripheral region surrounding the display region. In the peripheral region, a common voltage wiring, a voltage feedback wiring, a periodic signal wiring(s), and a decoupling wiring are disposed on the array substrate at intervals. The common voltage wiring is configured to transmit a common voltage signal for display to a pixel array in the display region. The voltage feedback wiring is configured to transmit a voltage feedback signal for monitoring changes in the common voltage signal. The periodic signal wiring(s) is/are configured to provide the pixel array with periodic signals for display. The decoupling wiring is located between the periodic signal wirings and the voltage feedback wiring and is configured to transmit a decoupling signal for reducing coupling distortion of the voltage feedback signal caused by coupling effect of the periodic signals.

At least one embodiment of the present disclosure further provides a driving method corresponding to the above display panel.

The display panel and the driving method thereof provided by the embodiments of the present disclosure can reduce the coupling effect of the periodic signals on the voltage feedback wiring, thereby avoiding occurrence of periodic horizontal stripe defects on the display panel.

The embodiments of the present disclosure will be described in detail below with reference to the drawings.

Figure 4:
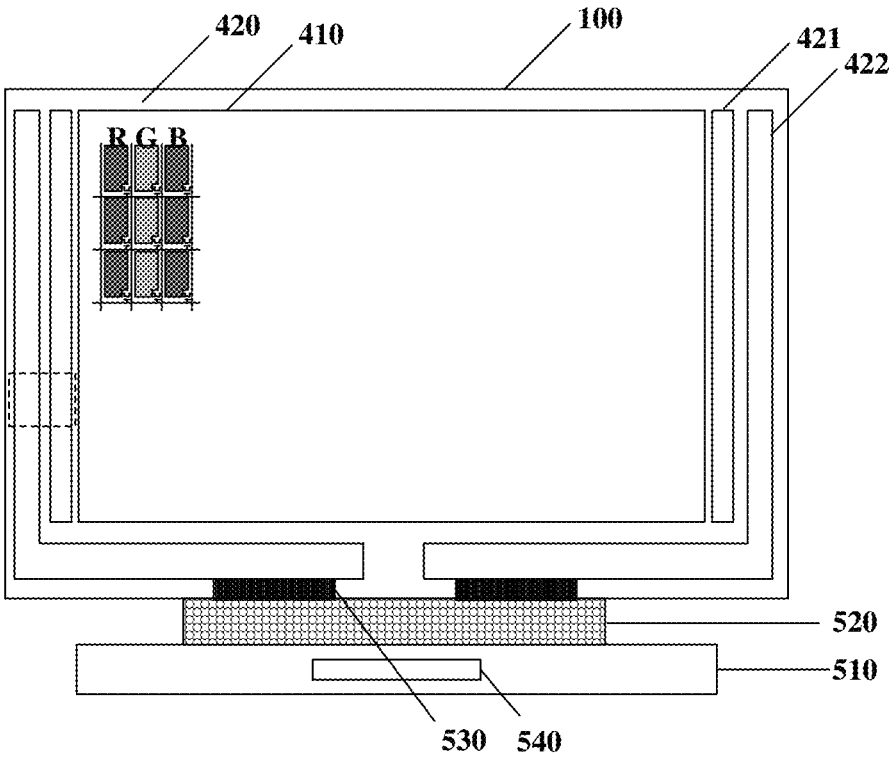
FIG. 4 is a schematic diagram of a display panel provided by some embodiments of the present disclosure.

Some embodiments of the present disclosure provide a display panel, and FIG. 4 shows a schematic diagram of the display panel. As shown in FIG. 4, the display panel comprises an array substrate 100, and comprises a display region 410 and a peripheral region 420 surrounding the display region 410. For example, a pixel array composed of a plurality of rows and a plurality of columns of pixel units (for example, each pixel including three kinds of pixel units RGB) is disposed in the display region 410 for display operations. It should be noted that only three rows and three columns of pixel units are schematically shown in FIG. 4, and the embodiments of the present disclosure include but are not limited thereto.

Figure 5:
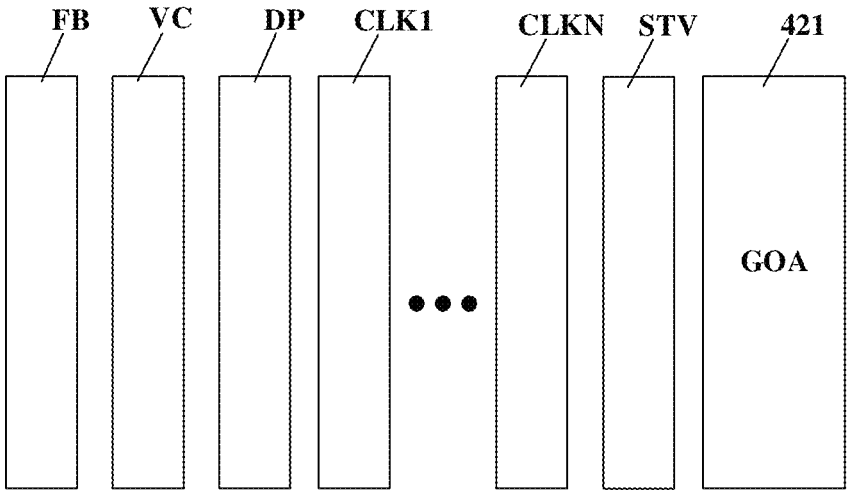
FIG. 5 is a schematic diagram 1 of a portion corresponding to a dotted frame in FIG. 4.

For example, as shown in FIG. 4, the peripheral region 420 includes a driving circuit region 421 and a wiring region 422. A driving circuit for driving the pixel array is disposed in the driving circuit region 421. For example, the driving circuit may adopt a gate driver on array (GOA) circuit. A plurality of wirings are arranged at intervals in the wiring region 422. For example, the plurality of wirings are parallel and insulated from each other. FIG. 5 is a schematic diagram of a portion corresponding to a dotted frame in FIG. 4. For example, as shown in FIG. 5, a common voltage wiring VC, a voltage feedback wiring FB, a periodic signal wiring(s), and a decoupling wiring DP are disposed on the array substrate 100 at intervals. For example, the common voltage wiring VC, the voltage feedback wiring FB, the periodic signal wirings, and the decoupling wiring DP may be formed in a same layer and in a same material on the array substrate 100. For example, in a direction perpendicular to a plate surface of the array substrate 100, heights of the plurality of wirings described above may be the same or may be different, which is not limited in the embodiments of the present disclosure.

It should be noted that, in the embodiments of the present disclosure, "formed in a same layer and in a same material" refers to being formed by patterning a same material layer through a same patterning process, a plurality of formed structures (for example, a plurality of wirings) do not necessarily lie on a same plane in physical space.

For example, as shown in FIG. 4, ends of the plurality of wirings may be connected to a printed circuit board 510 via electrode pins 530 and a flexible circuit film 520. For example, circuits disposed on the printed circuit board 510 may provide various signals required for driving display operations to the GOA circuit via the plurality of wirings.

For example, the common voltage wiring VC is configured to transmit a common voltage signal Vcom for display to the pixel array in the display region 410. For example, when the display panel is a liquid crystal display panel, respective pixel units in the pixel array may drive a liquid crystal to deflect according to a voltage difference between the common voltage signal Vcom and a data voltage applied to a pixel electrode, thereby achieving displays of different grayscales.

For example, the voltage feedback wiring FB is configured to transmit a voltage feedback signal for monitoring changes in the common voltage signal Vcom. For example, if the common voltage signal Vcom fluctuates, the voltage feedback wiring FB may monitor changes of the common voltage signal Vcom and output the voltage feedback signal. For example, the voltage feedback wiring FB may be connected to a distal end of the common voltage wiring VC (for example, an end near the printed circuit board 510 is a proximal end, and an end far from the printed circuit board 510 is the distal end), so that the common voltage signal Vcom may be monitored more accurately. For example, in an example, the display panel further comprises a signal processing circuit 540, and the voltage feedback wiring FB is connected to the signal processing circuit 540, so that the voltage feedback signal may be transmitted to the signal processing circuit 540 for further processing. For example, the signal processing circuit 540 may be disposed on the printed circuit board 510.

For example, the periodic signal wiring(s) is/are configured to provide the pixel array with periodic signals for display. For example, as shown in FIG. 5, the periodic signal wiring include a plurality of clock signal wirings (CLK1 . . . CLKN, N is an integer greater than 1) and a frame start signal wiring STY. For example, the clock signal wirings provide periodic clock signals to the GOA circuit, the frame start signal wiring STV provides a periodic frame start signal to the GOA circuit, and the GOA circuit, driven by the clock signals and the frame start signal, outputs a progressive scan signal for driving the pixel array to display. It should be noted that the periodic signal wirings in the embodiments of the present disclosure include, but are not limited to, the clock signal wirings and the frame start signal wiring STV shown in FIG. 5. For example, the periodic signal wirings may also include a frame reset signal wiring.

Figure 6:
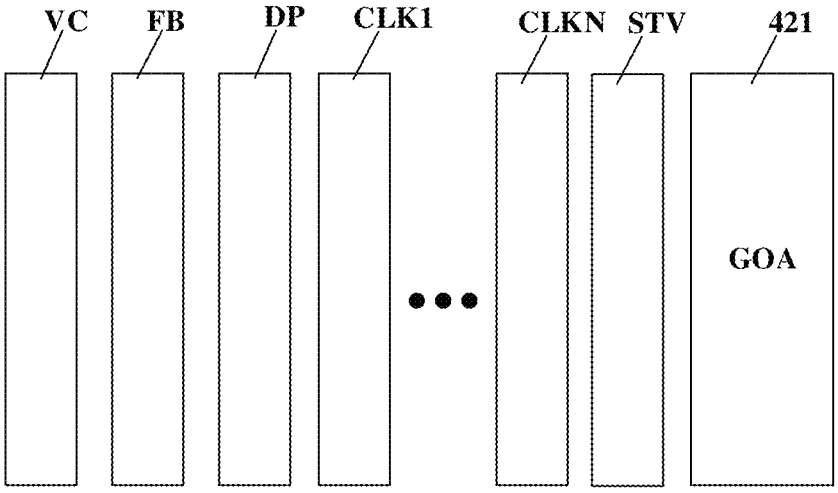
FIG. 6 is a schematic diagram 2 of a portion corresponding to the dotted frame in FIG. 4.

For example, as shown in FIG. 5 and FIG. 6, the decoupling wiring DP is located between the periodic signal wirings and the voltage feedback wiring FB with respect to a board surface of the array substrate 100, and is configured to transmit a decoupling signal used to reduce coupling distortion of the voltage feedback signal caused by coupling effect of the periodic signals.

It should be noted that, in the display panel provided by the embodiments of the present disclosure, relative positions of the common voltage wiring VC and the voltage feedback wiring FB are not limited. For example, in the example shown in FIG. 5, the voltage feedback wiring FB is located on a side of the common voltage wiring VC away from the clock signal wiring CLK1. As another example, in the example shown in FIG. 6, the voltage feedback wiring FB is located on a side of the common voltage wiring VC near the clock signal wiring CLK1.

Figure 7:
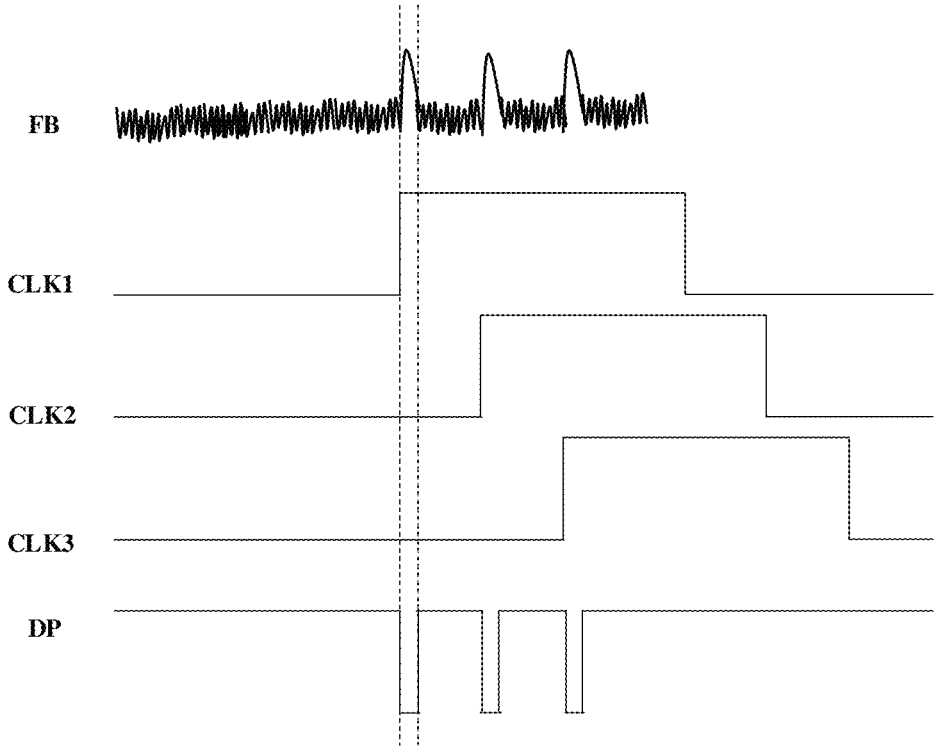
FIG. 7 is a schematic diagram 1 of signals transmitted by a voltage feedback wiring, clock signal wirings, and a decoupling wiring.
Figure 8:
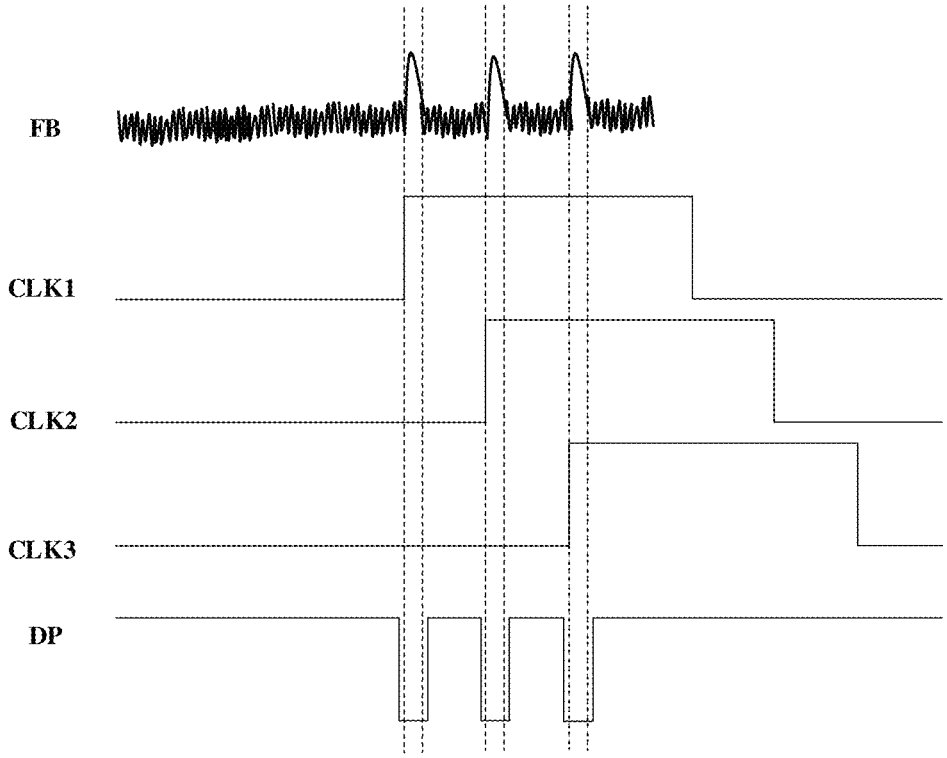
FIG. 8 is a schematic diagram 2 of signals transmitted by a voltage feedback wiring, clock signal wirings, and a decoupling wiring.

FIG. 7 and FIG. 8 show timing diagrams of the decoupling signal transmitted by the decoupling wiring DP, the voltage feedback signal and the periodic signals. It should be noted that, as an example, FIG. 7 and FIG. 8 are illustrated with the periodic signals as clock signals.

As shown in FIG. 7 and FIG. 8, the decoupling signal transmitted by the decoupling wiring DP is a periodic pulse signal. A pulse period of the decoupling signal is equal to a period in which the voltage feedback signal undergoes coupling distortion, and a phase of the decoupling signal is opposite to a phase of the voltage feedback signal undergoing coupling distortion. It should be noted that, in the embodiments of the present disclosure, a phase of the decoupling signal being opposite to a phase of the voltage feedback signal undergoing coupling distortion means that: when a potential of the voltage feedback signal undergoing coupling distortion becomes higher, a potential of the decoupling signal becomes lower correspondingly; when a potential of the voltage feedback signal undergoing coupling distortion becomes lower, a potential of the decoupling signal becomes higher correspondingly.

As shown in FIG. 7 and FIG. 8, when the clock signals transmitted by the clock signal wirings (CLK1, CLK2, CLK3) change (for example, from a low level to a high level), the voltage feedback signal transmitted by the voltage feedback wiring FB will undergo periodic distortion due to the coupling effect. When the voltage feedback signal undergoes periodic distortion, the phase of the decoupling signal is caused to be opposite to the phase of the voltage feedback signal, so that the decoupling signal wiring may apply coupling effect on the voltage feedback signal, thereby reducing the coupling distortion of the voltage feedback signal caused by the coupling effect of the periodic signals.

For example, in an example, the display panel further comprises a signal processing circuit 540 connected to the voltage feedback wiring FB and the decoupling wiring DP. The signal processing circuit 540 may output the decoupling signal to the decoupling wiring DP according to the received voltage feedback signal. For example, the signal processing circuit 540 may be disposed on the printed circuit board 510.

In the display panel provided by some embodiments of the present disclosure, by disposing the decoupling wiring DP between the periodic signal wirings and the voltage feedback wiring FB and enabling the decoupling wiring DP to transmit a decoupling signal, the coupling distortion of the voltage feedback signal caused by the coupling effect of the periodic signals may be reduced, thereby avoiding occurrence of periodic horizontal stripe defects on the display panel.

For example, in an example, as shown in FIG. 7, a pulse width of the decoupling signal is equal to a time during which the voltage feedback signal undergoes coupling distortion.

As another example, in another example, as shown in FIG. 8, the pulse width of the decoupling signal is greater than the time during which the voltage feedback signal undergoes coupling distortion.

During an actual debugging, if the display panel suffers from periodic horizontal stripe defects, coupling distortion of the voltage feedback signal may be reduced by adjusting the pulse width and/or pulse amplitude of the decoupling signal, so that periodic horizontal stripes may be avoided.

Through further experiments, the inventor found that for a display panel employing a scanning frequency of 60 Hz and 10 clock signal wirings (clock signals transmitted by the 10 clock signal wirings are a cycle), for example, frequency of a coupling distorted signal caused by the clock signal wirings on the voltage feedback wiring FB is 0.3 MHz, while under normal circumstances, frequency of a signal normally fed back by the voltage feedback wiring FB due to fluctuations of the common voltage signal is 240 Hz. Therefore, an earth capacitance may be formed on the array substrate, so that high-frequency coupling distorted signals in the voltage feedback signal may be filtered by using the earth capacitance, while fluctuations in the common voltage signal may be normally fed back at the same time.

Figure 9:
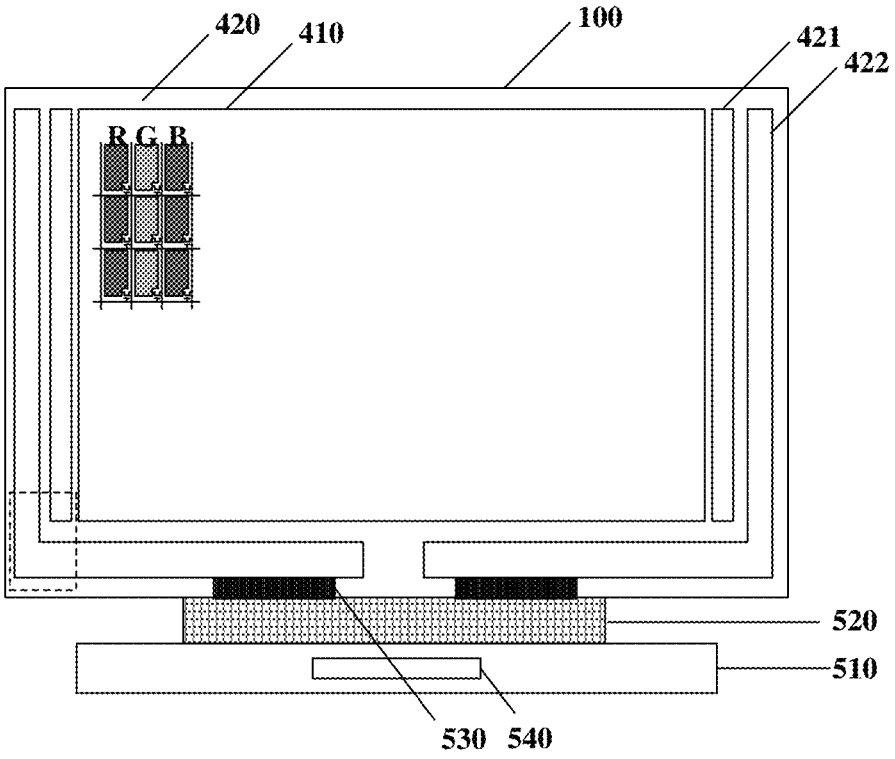
FIG. 9 is a schematic diagram of another display panel provided by some embodiments of the present disclosure.
Figure 10:
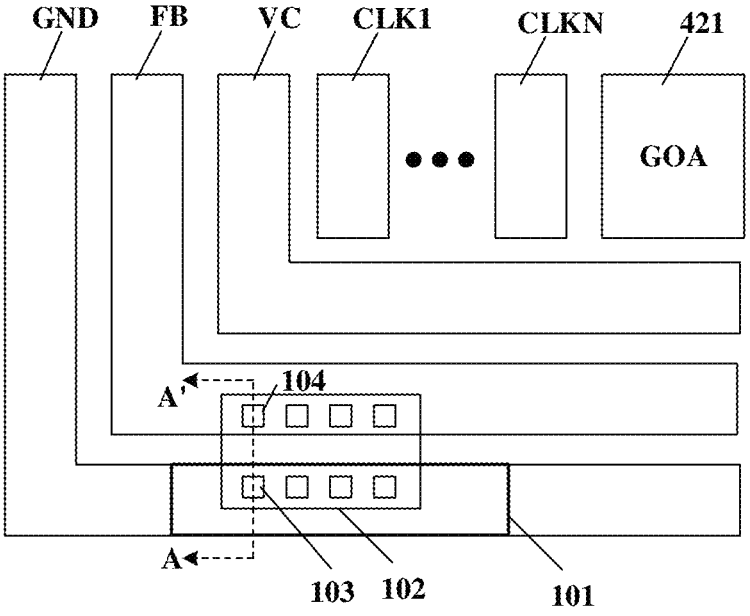
FIG. 10 is a schematic diagram 1 of a portion corresponding to a dotted frame in FIG. 9.

Some embodiments of the present disclosure further provide a display panel. As shown in FIG. 9, same parts of the display panel as the display panel shown in FIG. 4 will not be described repeatedly herein. FIG. 10 is a schematic diagram of a portion corresponding to a dotted frame in FIG. 9.

Figure 11:
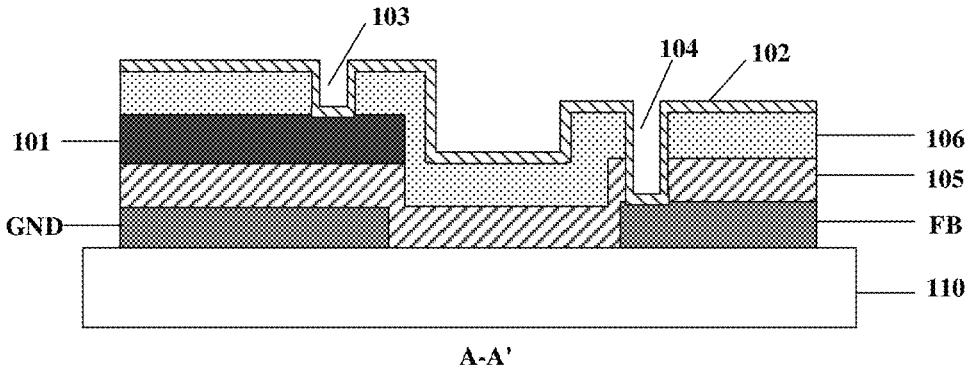
FIG. 11 is a cross-sectional view taken along a line A-A' in FIG. 10.

As shown in FIG. 10 and FIG. 11 (FIG. 11 is a cross-sectional view taken along a line A-A' in FIG. 10), in the peripheral region 420 of the display panel, a ground wiring GND separated from the voltage feedback wiring FB is further disposed on the array substrate 100, and the earth capacitance is formed between the voltage feedback wiring FB and the ground wiring GND. The earth capacitor is connected in parallel between the voltage feedback wiring FB and the ground wiring GND. For example, the earth capacitor is formed on an end of the voltage feedback wiring FB near the printed circuit board 510.

As shown in FIGS. 10 and 11, in an example, in the peripheral region of the display panel, the array substrate 100 includes a glass substrate 110 as a base substrate and a first conductive layer 101 disposed on the glass substrate 110. The first conductive layer 101 is insulated from the ground wiring GND, and an orthographic projection of the first conductive layer 101 on the array substrate (i.e., the glass substrate 110) and an orthographic projection of the ground wiring GND on the array substrate (i.e., the glass substrate 110) at least partially overlap. The first conductive layer 101 is electrically connected to the voltage feedback wiring FB, so that the earth capacitance is formed between the first conductive layer 101 and the ground wiring GND.

The voltage feedback wiring FB and the ground wiring GND are formed on the array substrate (i.e., the glass substrate 110) in a same layer and a same material. For example, the voltage feedback wiring FB and the ground wiring GND may be formed in a same layer and in a same material with a certain electrode in the display region, such that the voltage feedback wiring FB and the ground wiring GND may be formed in the peripheral region while the electrode is being formed in the display region through one patterning process. For example, other signal wirings such as the common voltage wiring, the clock signal wirings, etc. may also be formed while the voltage feedback wiring FB is being formed. Exemplarily, the base substrate may also be other type of substrates such as a plastic substrate, which is not limited herein.

For example, the first conductive layer 101 is formed in a same layer and in a same material with a gate or source-drain of a thin film transistor in the display region. When a switching element of a pixel unit of the display region adopts a bottom-gate thin film transistor, the voltage feedback wiring FB and the ground wiring GND may be formed through a same patterning process with the gate of the thin film transistor, and the first conductive layer 101 may be formed through a same patterning process with the source-drain of the thin film transistor. As another example, when a switching element of a pixel unit of the display region adopts a top-gate thin film transistor, the voltage feedback wiring FB and the ground wiring GND may be formed through a same patterning process with the source-drain of the thin film transistor, and the first conductive layer 101 may be formed through a same patterning process with the gate of the thin film transistor. The embodiments of the present disclosure are not limited thereto.

For example, as shown in FIG. 10 and FIG. 11, the array substrate 100 further includes a connection electrode 102. The connection electrode 102 is electrically connected to the first conductive layer 101 via a first through hole 103, and is insulated from the ground wiring GND. The connection electrode 102 is electrically connected to the voltage feedback wiring FB via a second through hole 104.

For example, as shown in FIG. 11, the array substrate 100 further includes a first insulating layer 105 and a second insulating layer 106. The first conductive layer 101 is insulated from the ground wiring GND by the first insulating layer 105. The first through hole 103 penetrates the second insulating layer 106, and the second through hole 104 penetrates the first insulating layer 105 and the second insulating layer 106. The connection electrode 102 is formed on the second insulating layer 106 and covers the first through hole 103 and the second through hole 104, so that the connection electrode 102 is electrically connected to the first conductive layer 103 via the first through hole 103, and, so that the connection electrode 102 is connected to the voltage feedback wiring FB via the second through hole 104.

For example, the first insulating layer 105 may be formed through a same patterning process with a gate insulating layer in the display region. The second insulating layer 106 may be formed through a same patterning process with a passivation layer in the display region.

In some embodiments of the present disclosure, the connection electrode 102 may be made of a transparent metal oxide, such as ITO (Indium Tin Oxide), etc.

Figure 12:
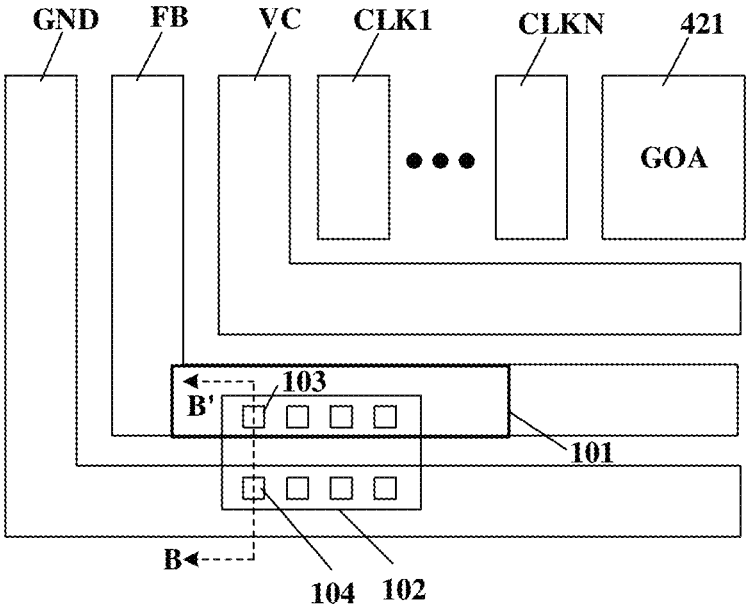
FIG. 12 is a schematic diagram 2 of a portion corresponding to the dotted frame in FIG. 9.
Figure 13:
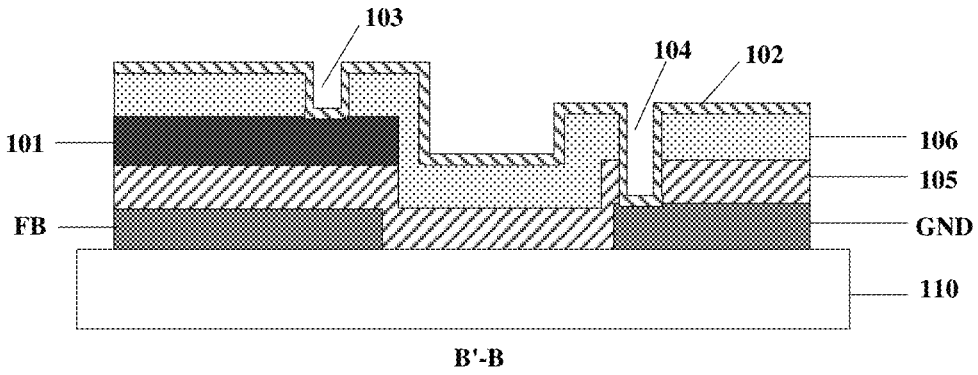
FIG. 13 is a cross-sectional view taken along a line B-B' in FIG. 12.

Some embodiments of the present disclosure further provide a display panel, as shown in FIGS. 12 and 13 (FIG. 13 being a cross-sectional view taken along a line B-B' in FIG. 12). In some embodiments of the present disclosure, the first conductive layer 101 is insulated from the voltage feedback wiring FB, and an orthographic projection of the first conductive layer 101 on the array substrate (i.e., the glass substrate 110) and an orthographic projection of the voltage feedback wiring FB on the array substrate (i.e., the glass substrate 110) at least partially overlap. The first conductive layer 101 is electrically connected to the ground wiring GND, so that an earth capacitance is formed between the first conductive layer 101 and the voltage feedback wiring FB. The connection electrode 102 is electrically connected to the first conductive layer 101 via the first through hole 103 and is insulated from the voltage feedback wiring FB. The connection electrode 102 is electrically connected to the ground wiring GND via the second through hole 104.

In the display panel provided by some embodiments of the present disclosure, by forming the earth capacitance between the voltage feedback wiring FB and the ground wiring GND, high-frequency coupling distorted signals in the voltage feedback signal may be filtered, while fluctuations in the common voltage signal may be normally fed back at the same time, so that coupling distortion of the voltage feedback signal may be reduced, thereby avoiding periodic horizontal stripes on the display panel.

Figure 14A:
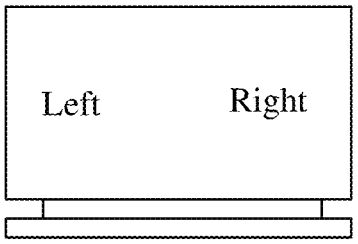
FIGS. 14A-14C are three schematic diagrams of excising an opposite substrate located in a peripheral region.
Figure 14B:
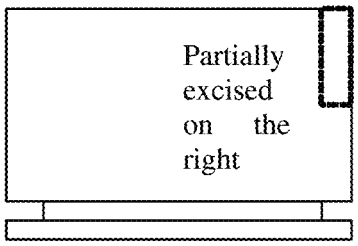
Figure 14C:
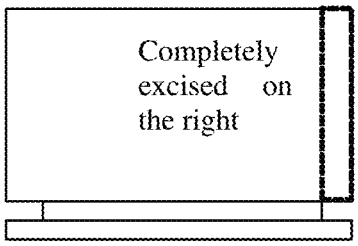

Through further experiments, the inventor found that when periodic horizontal stripes appear on the display panel, excision of an opposite substrate located in the peripheral region 420 may improve periodic horizontal stripe defects, and severity of the horizontal stripes is inversely proportional to an extent of the excision of the opposite substrate. For example, FIGS. 14A, 14B, and 14C show schematic diagrams of the opposite substrate located in the peripheral region 420 without being excised, partially excised on the right, and completely excised on the right, respectively, and corresponding voltage amplitudes of signals of the voltage feedback wiring FB undergoing coupling distortion are 0.24 V, 0.13 V, and 0.1 V, respectively.

On the opposite substrate, a black matrix BM is generally required in the display region and the peripheral region. Since a light shielding property is needed for the black matrix BM, a certain number of conductive particles (for example, carbon particles) are often added to materials of the black matrix BM. The conductive particles generate induced charges under action of periodic signals (such as clock signals transmitted on the clock signal wirings), and the voltage feedback wiring FB affected by the induced charges may have signal distortion. Therefore, in order to reduce influence of the black matrix BM on the voltage feedback wiring FB, a resistance value of the black matrix BM may be increased.

Figure 15:
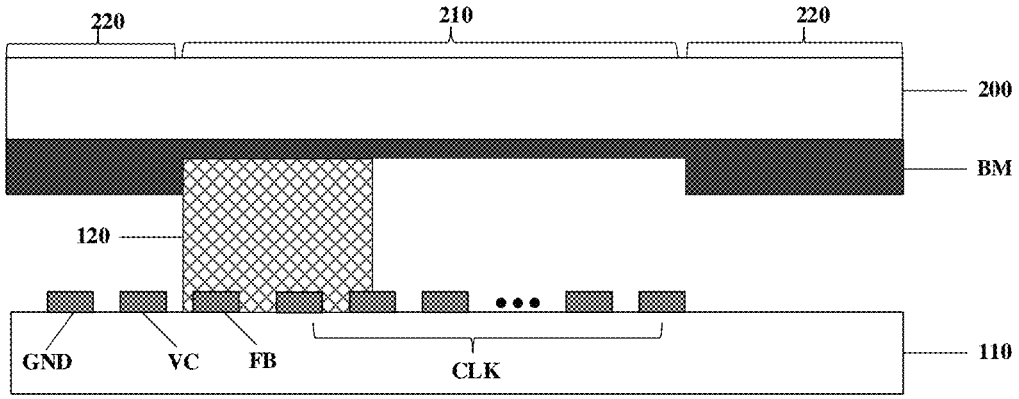
FIG. 15 is a cross-sectional view of yet another display panel provided by some embodiments of the present disclosure.

In some embodiments of the present disclosure, as shown in FIG. 15, the provided display panel further comprises an opposite substrate 200, which, for example, is a color film substrate. A black matrix BM is disposed on the opposite substrate, and a thickness of the black matrix BM disposed in a first region 210 is smaller than a thickness of the black matrix BM disposed in a second region 220. The first region 210 is a region including orthographic projections of the voltage feedback wiring FB and periodic signal wirings (such as the clock signal wirings CLKs or a frame start signal wiring) on the opposite substrate 200. The second region 220 is a region on the substrate 200 outside the first region 210. For example, the second region is a region in the peripheral region on the opposite substrate 200 other than the first region 210. For example, the second region is the display region.

For example, the thickness of the black matrix BM in the first region 210 may be made smaller than the thickness of the black matrix BM in the second region 220 by using a half tone mask (HTM) process when the black matrix is formed. As shown in FIG. 15, 120 in the figure indicates frame sealant.

In the embodiments of the present disclosure, the resistance value of the black matrix BM may be reduced by thinning the thickness of the black matrix BM in the first region 210, so that the black matrix BM's ability of inducing charges may be reduced, thereby reducing coupling effect of periodic signals on the voltage feedback wiring FB and avoiding occurrence of periodic horizontal stripe defects on the display panel.

Figure 16:
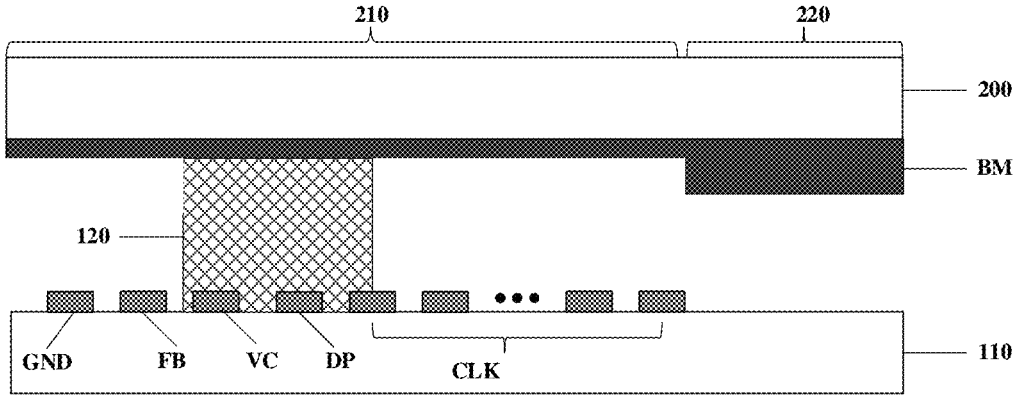
FIG. 16 is a cross-sectional view of still another display panel provided by some embodiments of the present disclosure.

For example, in a display panel provided by other embodiments, as shown in FIG. 16, in a case where a decoupling wiring DP is provided in the array substrate 100, the first region 210 further includes a region of orthographic projections of the common voltage wiring VC and the decoupling wiring DP on the opposite substrate 200. For example, the first region 210 further includes a region of the orthographic projection of the ground wiring GND on the opposite substrate 200. Compared with the embodiment shown in FIG. 15, the display panel shown in FIG. 16 may further reduce the resistance value of the black matrix BM, and thus reduce the black matrix BM's ability of inducing charges, thereby reducing coupling effect of periodic signals on the voltage feedback wiring FB and avoiding occurrence of periodic horizontal stripe defects on the display panel.

Some embodiments of the present disclosure further provide a driving method for a display panel, which may be used for any display panel provided by the embodiments of the present disclosure. The driving method includes transmitting a decoupling signal through a decoupling wiring DP, where the decoupling signal is used to reduce coupling distortion of a voltage feedback signal caused by coupling effect of periodic signals.

For example, in the driving method provided by some embodiments of the present disclosure, the decoupling signal is a periodic pulse signal; a pulse period of the decoupling signal is equal to a period in which the voltage feedback signal undergoes the coupling distortion, and a phase of the decoupling signal is opposite to a phase of the voltage feedback signal undergoing the coupling distortion.

For example, in the driving method provided by some embodiments of the present disclosure, a pulse width of the decoupling signal is equal to a time during which the voltage feedback signal undergoes the coupling distortion.

For example, in the driving method provided by some embodiments of the present disclosure, a pulse width of the decoupling signal is greater than a time during which the voltage feedback signal undergoes the coupling distortion.

The driving method provided in the embodiments of the present disclosure may reduce coupling effect of periodic signals on the voltage feedback wiring FB, thereby avoiding occurrence of periodic horizontal stripe defects on the display panel.

The above are only specific implementations of the present disclosure, but the scope of the present disclosure is not limited thereto. The scope of the present disclosure shall be subject to the scope of the accompanying claims.

What is claimed is:

1. A display panel comprising an array substrate, the display panel comprising a display region and a peripheral region surrounding the display region, wherein:

in the peripheral region, a common voltage wiring, a voltage feedback wiring, a periodic signal wiring, and a decoupling wiring are disposed on the array substrate at intervals;

the common voltage wiring is configured to transmit a common voltage signal for display to a pixel array in the display region, the voltage feedback wiring is configured to transmit a voltage feedback signal for monitoring changes in the common voltage signal, the periodic signal wiring is configured to provide the pixel array with a periodic signal for display, the decoupling wiring is located between the periodic signal wiring and the voltage feedback wiring, and is configured to transmit a decoupling signal for reducing coupling distortion of the voltage feedback signal caused by coupling effect of the periodic signal.

2. The display panel according to claim 1, wherein the decoupling signal is a periodic pulse signal;

a pulse period of the decoupling signal is equal to a period in which the voltage feedback signal undergoes the coupling distortion, a phase of the decoupling signal is opposite to a phase of the voltage feedback signal undergoing coupling distortion.

3. The display panel according to claim 2, wherein a pulse width of the decoupling signal is equal to a time during which the voltage feedback signal undergoes the coupling distortion.

4. The display panel according to claim 2, wherein a pulse width of the decoupling signal is greater than a time during which the voltage feedback signal undergoes the coupling distortion.

5. The display panel according to claim 1, wherein the periodic signal wiring includes a clock signal wiring and/or a frame start signal wiring.

6. The display panel according to claim 1, wherein the display panel further comprises a signal processing circuit, the signal processing circuit is connected to the decoupling wiring and is configured to output the decoupling signal to the decoupling wiring.

7. The display panel according to claim 1, wherein in the peripheral region, a ground wiring separated from the voltage feedback wiring is further provided on the array substrate, and an earth capacitance is formed between the voltage feedback wiring and the ground wiring.

8. The display panel according to claim 7, wherein in the peripheral region, the array substrate further comprises a first conductive layer and a connection electrode, the first conductive layer is insulated from the ground wiring, an orthographic projection of the first conductive layer on the array substrate and an orthographic projection of the ground wiring on the array substrate at least partially overlap, and the first conductive layer is electrically connected to the voltage feedback wiring, so that the earth capacitance is formed between the first conductive layer and the ground wiring;

the connection electrode is electrically connected to the first conductive layer via a first through hole and is insulated from the ground wiring, and the connection electrode is electrically connected to the voltage feedback wiring via a second through hole.

9. The display panel according to claim 7, wherein in the peripheral region, the array substrate further comprises a first conductive layer and a connection electrode, the first conductive layer is insulated from the voltage feedback wiring, an orthographic projection of the first conductive layer on the array substrate and an orthographic projection of the voltage feedback wiring on the array substrate at least partially overlap, and the first conductive layer is electrically connected to the ground wiring, so that the earth capacitance is formed between the first conductive layer and the voltage feedback wiring;

the connection electrode is electrically connected to the first conductive layer via a first through hole and is insulated from the voltage feedback wiring, and the connection electrode is electrically connected to the ground wiring via a second through hole.

10. The display panel according to claim 8, wherein the first conductive layer and a gate or a source-drain of a thin film transistor in the display region are formed in a same layer and a same material.

11. The display panel according to claim 7, wherein the ground wiring and the voltage feedback wiring are formed in a same layer and a same material on the array substrate.

12. The display panel according to claim 1, further comprising an opposite substrate, wherein:

a black matrix is disposed on the opposite substrate, and a thickness of the black matrix disposed in a first region is smaller than a thickness of the black matrix disposed in a second region, the first region is a region including orthographic projections of the voltage feedback wiring and the periodic signal wiring on the opposite substrate, and the second region is a region on the opposite substrate outside the first region.

13. The display panel according to claim 12, wherein the first region further comprises a region of orthographic projections of the common voltage wiring and the decoupling wiring on the opposite substrate.

14. The display panel according to claim 12, wherein the opposite substrate comprises a color film substrate.

15. A driving method for the driving a display panel, said display panel comprising an array substrate, a display region and a peripheral region surrounding the display region, in the peripheral region, a common voltage wiring, a voltage feedback wiring, a periodic signal wiring, and a decoupling wiring are disposed on the array substrate at intervals, the common voltage wiring is configured to transmit a common voltage signal for display to a pixel array in the display region, the voltage feedback wiring is configured to transmit a voltage feedback signal for monitoring changes in the common voltage signal, the periodic signal wiring is configured to provide the pixel array with a periodic signal for display, and the decoupling wiring is located between the periodic signal wiring and the voltage feedback wiring, wherein said driving method comprising:

transmitting the decoupling signal via the decoupling wiring, and the decoupling signal is used to reduce coupling distortion of the voltage feedback signal caused by coupling effect of the periodic signal.

16. The driving method according to claim 15, wherein the decoupling signal is a periodic pulse signal;

a pulse period of the decoupling signal is equal to a period in which the voltage feedback signal undergoes the coupling distortion, a phase of the decoupling signal is opposite to a phase of the voltage feedback signal undergoing the coupling distortion.

17. The driving method according to claim 16, wherein a pulse width of the decoupling signal is equal to a time during which the voltage feedback signal undergoes the coupling distortion.

18. The driving method according to claim 16, wherein a pulse width of the decoupling signal is greater than a time during which the voltage feedback signal undergoes the coupling distortion.

* * * * *